US006056274A

United States Patent [19]

Naas et al.

[11] Patent Number: 6,056,274

[45] Date of Patent: May 2, 2000

[54] BOAT HOIST APPARATUS

[76] Inventors: Jane Eldredge Naas; Robert Lee Naas, both of 8 W. Elizabeth St., Skaneateles, N.Y. 13152

[21] Appl. No.: 09/088,639

[22] Filed: Jun. 2, 1998

Related U.S. Application Data

[60] Provisional application No. 60/048,366, Jun. 3, 1997.

[51] Int. Cl.[7] ..... B66D 1/36

[52] U.S. Cl. ..... 254/335; 254/338; 254/393; 254/394; 254/400; 248/317; 248/323; 248/328; 248/343

[58] Field of Search ..... 254/335, 338, 254/393, 394, 400; 248/317, 323, 328, 343

[56] References Cited

U.S. PATENT DOCUMENTS

| | | | |
|---|---|---|---|
| 2,649,279 | 8/1953 | Joes et al. | 254/338 |
| 3,265,024 | 8/1966 | Kramlich . | |
| 3,454,259 | 7/1969 | Faulkner | 254/338 |
| 4,600,177 | 7/1986 | Fritz | 254/338 |
| 4,764,081 | 8/1988 | Peterson . | |
| 5,051,027 | 9/1991 | Horton | 254/338 |
| 5,131,620 | 7/1992 | Boundy | 248/317 |
| 5,193,479 | 3/1993 | Bielefeld . | |
| 5,263,687 | 11/1993 | Garbiso | 254/334 |
| 5,320,394 | 6/1994 | Urbank . | |
| 5,794,793 | 8/1998 | Frederick | 248/343 |

*Primary Examiner*—Donald P. Walsh
*Attorney, Agent, or Firm*—Wall Marjama Bilinski & Burr

[57] ABSTRACT

An apparatus for selectively raising, storing, and lowering a recreational water craft that includes a first cable. The first cable is attached at one end to a winch for selectively shortening or lengthening the first cable. The first cable is attached at the other end to a ring and the first cable passes through a first pulley. A proximal strap is releasably and adjustably attached to the boat and is connected to a second cable. The second cable is connected at one end to the proximal strap and at the other end to the ring. A distal strap is releasably and adjustably attached to the boat. The distal strap is connected to a third cable, with the third cable being attached at one end to the distal strap and at the other end to a size adjustment assembly. The size adjustment assembly is connected to the ring.

4 Claims, 1 Drawing Sheet

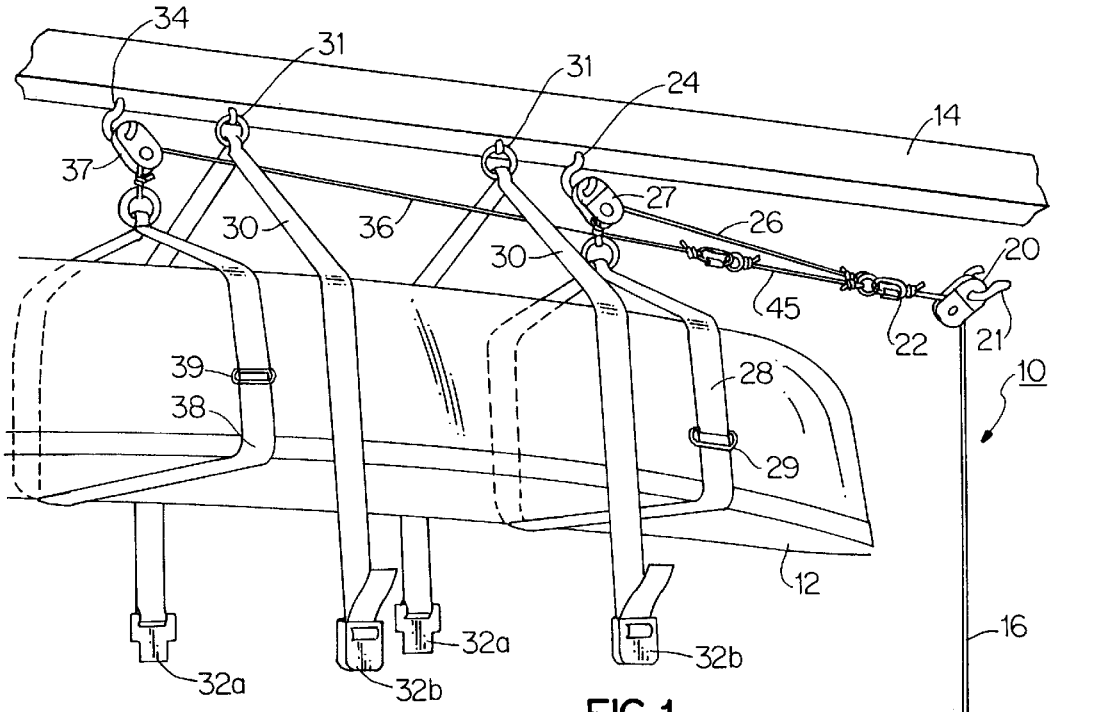
FIG.1
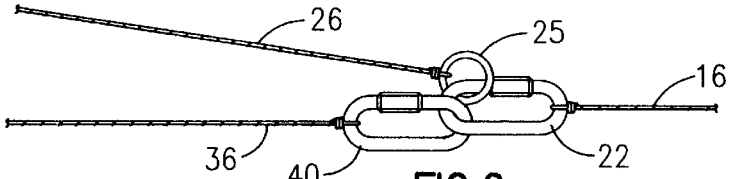
FIG.2
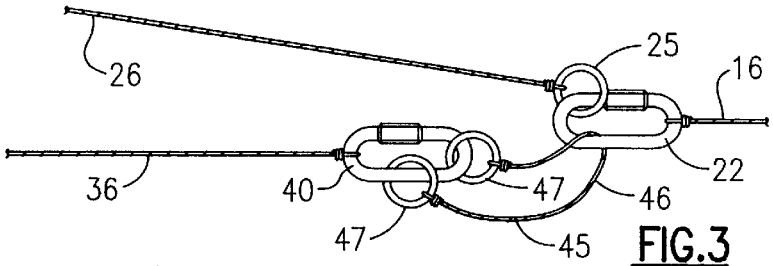
FIG.3
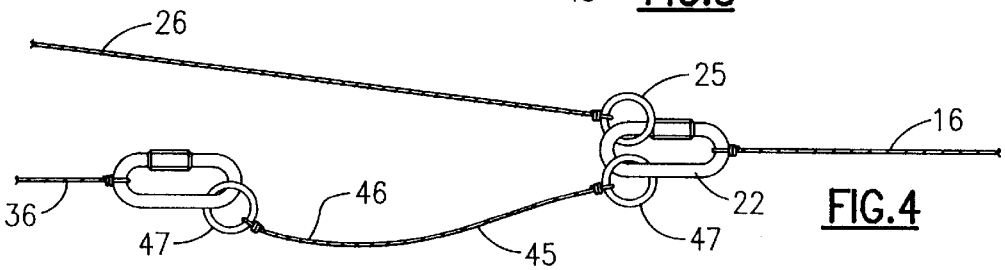
FIG.4
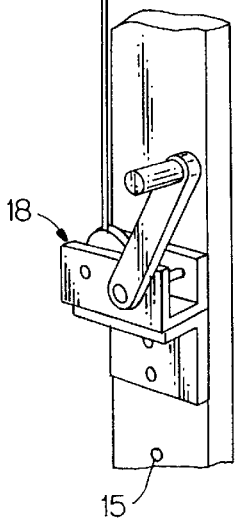

BOAT HOIST APPARATUS

CROSS REFERENCE TO RELATED APPLICATION

Reference is made to and priority claimed from U.S. Provisional Application Ser. No. 60/048,366 filed Jun. 3, 1997, entitled BOAT HOIST.

BACKGROUND OF THE INVENTION

This invention relates to boat hoists, and more specifically relates to an apparatus for raising, storing, and lowering a small water craft.

Most devices that are used to raise, store and lower boats are comprised of complicated systems that do not easily adjust to various size boats, particularly boats that are used recreationally such as rowboats, small sailboats, canoes and kayaks or adjust to various structure requirements. In addition, the prior art devices are not adaptable to be used on various size boats without the need for a major reconfiguration of the device.

A boat lift for small boats is described in U.S. Pat. No. 3,265,024 to Kramlich. The harness, used to dry dock a boat, includes a pair of floatation pipes and fabric stripping that connects the pipes to a lifting ring. The device disclosed in Kramlich utilizes rigidly constructed lift bars to provide support to the keel of the boat.

A lifting and storing device for use with small boats that can be attached to the transom of a larger boat is described in U.S. Pat. No. 5,193,479 to Bielefeld. The device utilizes a tubular cradle that includes a pivot arm. The pivot arm is arranged to rest in contact with a swim platform that is suspended from the transom of the larger boat. A block and tackle assembly is attached to the transom of the larger boat and operates to lift the smaller craft out of the water and place it in a stored position upon the swim platform.

A boat lift utilizing a series of straps designed to pass under the boat is disclosed in U.S. Pat. No. 4,764,081 to Peterson. One end of each strap is anchored high upon a vertically disposed standard and the opposite end is attached to a lifting drum positioned at a higher elevation on the standard than the anchor points. The lifting drums are connected to a common shaft along a hand wheel that can be turned to cause the boat to be lifted and turned over.

Although the devices described in the prior art work well in their respective environments, the devices lack the ability to provide a simple apparatus for the raising/lowering and storing of a recreational type water craft in locations such as the garage of the owner, a small storage shed, or a retail operation. The devices described in the prior art are not easily adaptable for use with various size boats within the recreational size range. Additionally, the prior art does not provide an apparatus for storing the boat wherein the load of the boat is easily removed from the raising/lowering portion of the device and placing the mechanical load upon a secure storage device.

OBJECTS AND SUMMARY OF THE INVENTION

It is therefore an object of the invention to provide an easy to use boat hoist for the raising, storing, and lowering of a recreational size water craft.

It is a further object of the invention to provide a boat hoist that can be easily adapted to handle various sizes of boats within the recreational water craft size range.

It is another object of the invention to provide a boat hoist that can be easily adapted to provide safe and secure storage of a recreational size water craft.

A further object of the invention is to provide a small boat hoist that can be easily and quickly adapted for mounting on the rafters of a garage or a storage shed for safely storing the boat at an elevated position.

These and other objectives are obtained by providing an apparatus that includes a first cable. The first cable is attached at one end to a winch, or any other mechanical device for selectively shortening or lengthening the first cable or can be hand drawn when lifting a reasonably light load. The first cable is attached at the other end to a ring and the first cable passes through a first pulley. A proximal strap is releasably attached to the boat and is connected to a second cable. The second cable is connected at one end to the proximal strap and at the other end to the ring. A distal strap is releasably attached to the boat. The distal strap is connected to a third cable, with the third cable being attached at one end to the distal strap and at the other end to a size adjustment assembly, which is connected to the ring. The water craft is raised and lowered by selectively shortening or lengthening the first cable.

BRIEF DESCRIPTION OF THE DRAWINGS

FIG. 1 is a side elevation, in partial section, showing a boat hoist embodying the teachings of the present invention.

FIG. 2 is an enlarged side view of a portion of the boat hoist embodying the teachings of the present invention.

FIG. 3 is an enlarged side view of a second configuration of the same portion of the boat hoist as depicted in FIG. 2 which embodies the teachings of the present invention.

FIG. 4 is an enlarged side view of a third configuration the same portion of the boat hoist as depicted in FIG. 2 and FIG. 3 which embodies the teachings of the present invention.

DETAILED DESCRIPTION OF THE INVENTION

Referring now to FIG. 1, there is a shown a boat hoist 10 that embodies the preferred embodiment of the present invention. The hoist 10 is deployed about a recreational water craft, in this particular example a canoe 12 is shown. It is understood that the hoist 10 can be used with various size recreational water craft, including but not limited to such craft as canoes, rowboats, small sailboats and kayaks. The hoist 10 is designed to be used in a garage, storage shed, or small building or other free standing structure that provides an overhead support surface 14, such as wooden beams or rafters. The support surface 14 must be able to support the entire weight of the hoist 10 and the recreational water craft 12.

There is a first cable 16, preferably constructed of metal, strong plastic or natural fibers, that is connected at one end to a crank brake-winch 18. The brake-winch 18 includes a drum upon which the cable is wound and thereby to selectively shorten or lengthen the first cable 16. One skilled in the art would recognize that there are many means for selectively shortening or lengthening the first cable 16, such as a mechanical winch, a mechanical brake-wheel, or powered winches, or by hand. Of course, the means for shortening or lengthening the first cable 16 must provide adequate mechanical force to raise and lower the water craft 12. In the preferred embodiment, the mechanical brake-winch 18 is mounted on a side wall or post of the structure in which it is housed in a position that affords the user with easy access to the winch 18. The crank brake-winch 18 is used because it provides the user with the ability to release the handle of the winch 18 without the craft 12 unintentionally falling.

The first cable 16 passes through a first pulley 20 that is anchored in the wall or ceiling of the structure by any suitable attachment means, such as threaded hook 21. The first cable 16 is attached to a ring 22, which in the preferred embodiment is an openable link. There is a second cable 26 that is attached at one end to the ring 22 by any suitable means, such as a round connector 25 as depicted in FIGS. 2, 3 and 4. Referring again to FIG. 1, the second cable 26 passes through a second pulley 27 which is connected to the support surface, such as rafter 14, preferably by a second threaded hook 24. The other end of the second cable 26 is connected to a front lifting strap 28 which is releasably and adjustably secured to the water craft 12. One skilled in the art would recognize that there are various ways to releasably and adjustably secure the front lifting strap 28 to the water craft 12, such as a pull-through adjustable locking buckle 29.

A third cable 36 is connected at one end to a rear lifting strap 38 that is also releasably and adjustably secured to the water craft 12 by such means as a pull-through adjustable locking buckle 39. The third cable 36 passes through a third pulley 37 which is connected to the support surface 14, preferably by a third threaded hook 34. The third cable 36 is attached at the other end to the ring 22 as shown in FIG. 2, third cable 36 is attached to ring 22 by an openable link 40.

Typically, the front lifting strap 28 and the rear lifting strap 38 are secured to the water craft 12 while the craft 12 is resting on the ground. Mechanical force is applied to the winch 18 which causes the first cable 16 to shorten in length. The shortening of first cable 16 causes the second cable 26 and the third cable 36 to travel in a direction towards the first pulley 20. The travel of the second cable 26 and the third cable 36 causes the front lifting strap 28 and the rear lifting strap 38 to move vertically upward, thereby raising the water craft 12 off the ground. In this manner, the craft 12 can be moved to a suitable storage height above the ground.

Again referring to FIG. 1, an additional safety feature if provided by at least one but preferably a plurality of support straps 30-30. The support straps 30-30 are constructed of nylon webbing or any other suitable material of a fixed or adjustable length and can include a seat-belt type male-female buckle 32*a*/32*b* provided on the ends. The support straps 30-30 are attached to the support surface 14 by suitable connecting means, such as eye-hooks 31-31. When the craft 12 is lifted to a suitable position off the ground, the user employs the support straps 30 by connecting the buckles 32*a*/32*b* and adjusting the support straps 30-30 to tighten about the craft. Once the buckles 32*a*/32*b* are fastened and tightened, the support straps 30-30 provide a secondary means of supporting the craft 12, thereby releasing some or all of the mechanical force on the front and rear lifting straps, and the supporting first cable 16, second cable 26, and third cable 36. If desired, after the support straps 30-30 have been locked in place the winch 18 can be reversed to slightly lengthen the first cable 16, with the result being that the support straps 30-30 will bear some or all of the weight of the water craft 12 while the craft is stored. In addition to the improved safety provided by the use of the support straps 30-30, the several components of the hoisting mechanism are relieved of mechanical stress which will lengthen the life span of the components.

To lower the craft 12, the winch 18 is employed to shorten the first cable 16 in order to have the front and rear lifting straps support the entire weight of the craft 12. The support straps 30-30 are then unbuckled, and the winch 18 is employed to lengthen the first cable 16 until the craft 12 is lowered safely to the ground. The front lifting 28 and the rear lifting strap 38 are then released from the craft 12 and the user is free to move the craft 12.

An additional feature of the present invention provides the ability to use the hoist 10 with various size water craft 12. The size or length of the water craft 12 dictates the proper distance that should exist between the proximal strap 28 and the distal strap 38. The rear strap 38 is repositioned to the optimal distance from the front strap 28 by repositioning the third pulley 37. One skilled in the art would recognize a number of ways to reposition the third pulley 37, including manually repositioning the second hook 34. For a larger water craft, the distal strap 38 must be positioned at a greater distance from the proximal 28 than for a smaller craft. By necessity, the distance covered by the third cable 36 will be greater in the new configuration. Rather than replace the third cable 36 with a longer cable, the present invention utilizes a size adjustment assembly 45. In the preferred embodiment, the assembly 45 includes a length of cable 46 made of metal, strong plastic or natural fiber with a connecting ring 47 located at each end. Referring now to FIG. 3, the size adjustment assembly 45 is configured for a medium size water craft. The assembly 45 is connected to the openable link 40 of third cable 36 at both ends of the assembly 45. The assembly 45 is looped through ring 22, thereby providing a connection between the third cable 36 and the ring 22. As illustrated in FIG. 4, the assembly 45 is shown configured to be used on a longer size water craft. One end of the assembly 45 is connected to the openable link 40 of the third cable 36 and the other end of the assembly 45 is connected to the ring 22. In this manner, the length of the distance between ring 22 and the distal strap 38 is longer without the need to replace the third cable 36 with a longer cable. Depending upon the size of the water craft to be stored, the user can select the proper configuration of the size adjustment assembly 45. This arrangement can also be used to accommodate various spacing between pulleys dictated by the construction of the supporting structure, for example, the code required spacing between structural members.

While this invention has been explained with reference to the structure disclosed herein, it is not confined to the details set forth and this invention is intended to cover any modifications and changes as may come within the scope of the following claims:

We claim:

1. An apparatus for raising, lowering and storing a water craft, said apparatus comprising:

a first cable attached at one end to a winch means for selectively winding or unwinding said first cable, said first cable attached at the other end to a ring, said first cable passing through a first pulley;

a front lifting strap releasably and adjustably attached to the craft, said front lifting strap connected to a second cable, said second cable connected at one end to said front lifting strap and at the other end said ring; and, a rear lifting strap releasably and adjustably attached to the craft, said rear lifting strap connected to a third cable, said third cable attached at one end to said rear lifting strap and at the other end to a size adjustment assembly, said size adjustment assembly connected to said ring.

2. The apparatus of claim 1 wherein said size adjustment assembly comprises: a length of material with two ends, said material including a connector at each end.

3. The apparatus of claim 1 further comprising:

at least one safety strap, said safety strap including means for releasably and adjustably securing the craft.

4. The apparatus of claim 3 wherein said means for releasably securing the craft comprises a buckle adjustably attached to said strap whereby the strap can be tightened about the craft.

* * * * *